US005130948A

United States Patent [19]

Laukien et al.

[11] Patent Number: 5,130,948

[45] Date of Patent: Jul. 14, 1992

[54] METHOD AND APPARATUS FOR REDUCING ACOUSTIC EMISSION FROM SUBMERGED SUBMARINES

[75] Inventors: Gunther Laukien, Silberstreifen, D-7512 Rheinstetten-Forchheim; Arne Kasten, Karlsruhe, both of Fed. Rep. of Germany

[73] Assignee: Gunther Laukien, Rheinstetten-Forcheim, Fed. Rep. of Germany

[21] Appl. No.: 602,310

[22] PCT Filed: Mar. 16, 1990

[86] PCT No.: PCT/DE90/00192

§ 371 Date: Nov. 15, 1990

§ 102(e) Date: Nov. 15, 1990

[87] PCT Pub. No.: WO90/10926

PCT Pub. Date: Sep. 20, 1990

[30] Foreign Application Priority Data

Mar. 16, 1989 [DE] Fed. Rep. of Germany .... 3908577.5

[51] Int. Cl.[5] ..... H04K 3/00

[52] U.S. Cl. ..... 367/1; 181/140; 181/402; 114/312; 310/328

[58] Field of Search ..... 367/1, 191; 181/140, 181/5, 402; 114/312, 342; 310/328, 334, 337

[56] References Cited

U.S. PATENT DOCUMENTS 4,083,433 4/1978 Geohegan et al. ..... 188/1 B

FOREIGN PATENT DOCUMENTS 0063517 4/1982 European Pat. Off. .
0120520 2/1984 European Pat. Off. .
0213418 8/1986 European Pat. Off. .
0237891 3/1987 European Pat. Off. .
315237 2/1917 Fed. Rep. of Germany .
315238 4/1917 Fed. Rep. of Germany .
2318305 4/1973 Fed. Rep. of Germany .
3300067 1/1983 Fed. Rep. of Germany .
3332754 9/1983 Fed. Rep. of Germany .
3406343 2/1984 Fed. Rep. of Germany .
3600258 1/1986 Fed. Rep. of Germany .
3827240 8/1988 Fed. Rep. of Germany .
264658 10/1987 German Democratic Rep. .
62-28874 3/1986 Japan .
8303700 4/1983 PCT Int'l Appl. .
2122052 5/1983 United Kingdom .
2146295 9/1984 United Kingdom .
2221743 7/1989 United Kingdom .

OTHER PUBLICATIONS

German Journal Militärtechnik Apr. 1981, "Einsatz von Dämpfungselementen zur Lärm- und Schwingungsbekämpfung" from R. Berger and F. Kupke, pp. 210–212.

German Journal HANSA-Schiffahrt-Schiffbau-Hafen, 126.vol., 1989, No. 5, Bordaggreagte für Marineschiffe, pp. 310–312.

German Journal HANSA-Schiffahrt-Schiffbau-Hafen, 126.vol. No. 5, "Diesemmotoren und Antriebsanlagen für Marineschiffe" from H. Pleimling, pp. 308–309.

German Journal HANSA-Schiffahrt-Schiffbau-Hafen, 109.vol., 1972, Nov., "elastische Aufstellung von Motoren und Aggregaten unter Verwendung von geregelten Luftfedern", pp. 2055–2068.

German Journal Technische Rundschau, Sep. 1988-"Schwingungstechnik im Maschinenbau" from F. Kunz and H. Meier, pp. 40–45.

(List continued on next page.)

*Primary Examiner*—J. Woodrow Eldred
*Attorney, Agent, or Firm*—Rosenblum, Parish & Isaacs

[57] ABSTRACT

A method and an apparatus are disclosed serving to reduce acoustic emission from submerged submarines in which vibrations from moving mechanical elements within an inner region are transmitted to an outer hull via a vibration transmission path. For decoupling the outer hull as completely as possible from the moving mechanical elements, for example periodically moving nuclear reactor control rods, the vibrations are actively damped. Means are provided for ascertaining the motion of the mechanical elements relative to the outer hull and for superimposing upon said motion of counter-motion of opposite direction.

1 Claim, 4 Drawing Sheets

OTHER PUBLICATIONS

Figure 1:
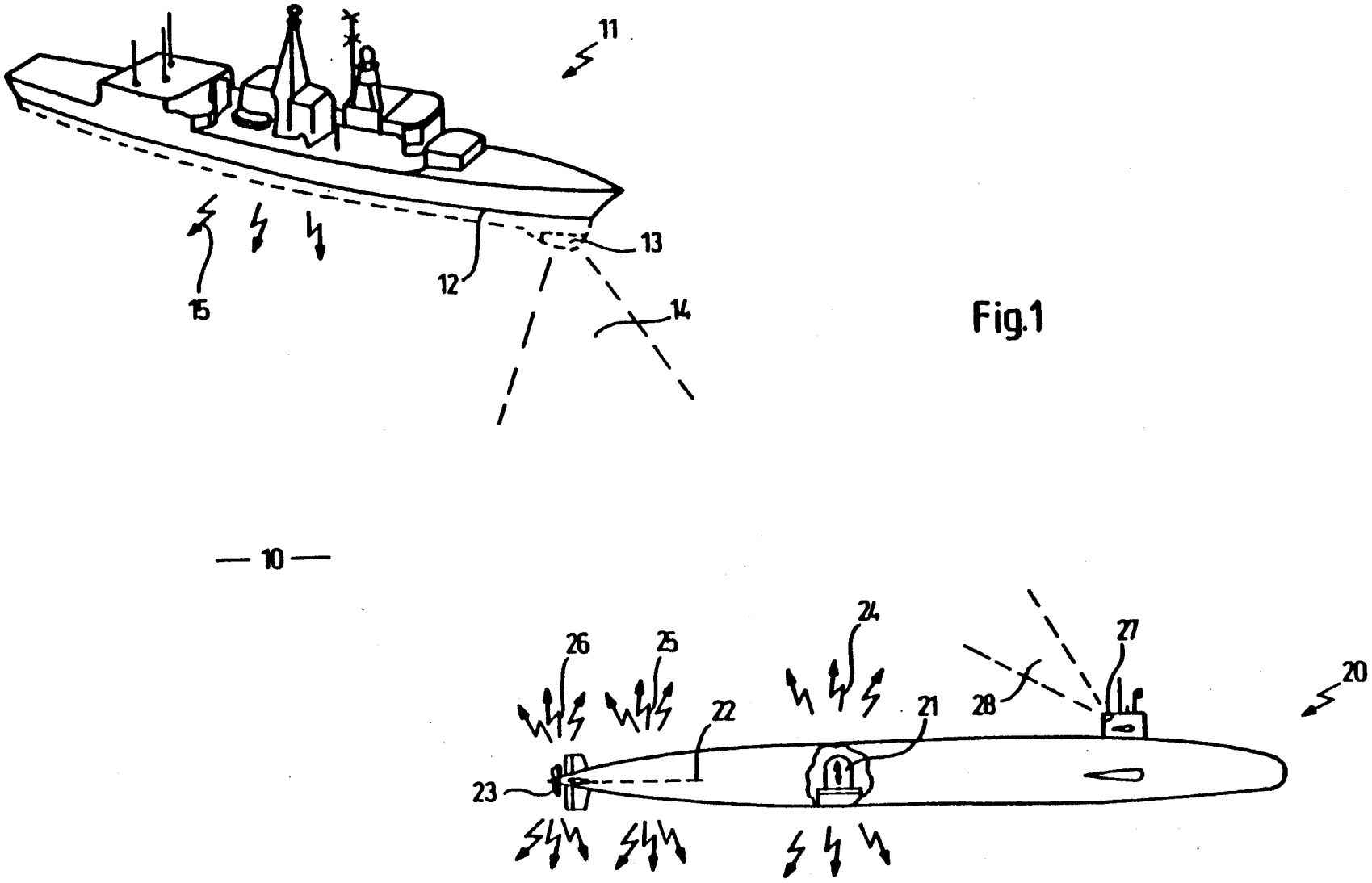

Literature: Soviet Physics, Acoustics, vol. 23, No. 3, May/Jun. 1977, American Institude of Physics (New York, US), Author: V. Yu Katinas et al: "Active vibrationsuppression techniques for mechanical systems with many degrees of freedom" pp. 273, 274.

Literature: Applied Acoustics, vol. 17, No. 2, 1984, Elsevier Applied Science Publishers (London, GB) Author A. D. White et al: "An adaptive controller for multivariable active noise control".

German Book from Gabler "Unterseebootbau", vol. 3, Koblenz 1987, p. 72.

German Book from Springer-Verlag—Jahrbuch der Schiffbautechnischen Gesellschaft 82, vol. 1988, Berlin 1989, "Die dieselelektrische Fahranlage des Saclant—Forschungsschiffes alliance und die Besonderheit hinsichtlich Körper— und Luftschall" from W. Hensel, pp. 28-32.

German Journal Schiff und Hafen, 17.vol. Journal Dec., 1965 "Schalltechnische Erfahrungen mit doppelelastischen Maschinenlagerungen" from A. A. Mueller, p. 989.

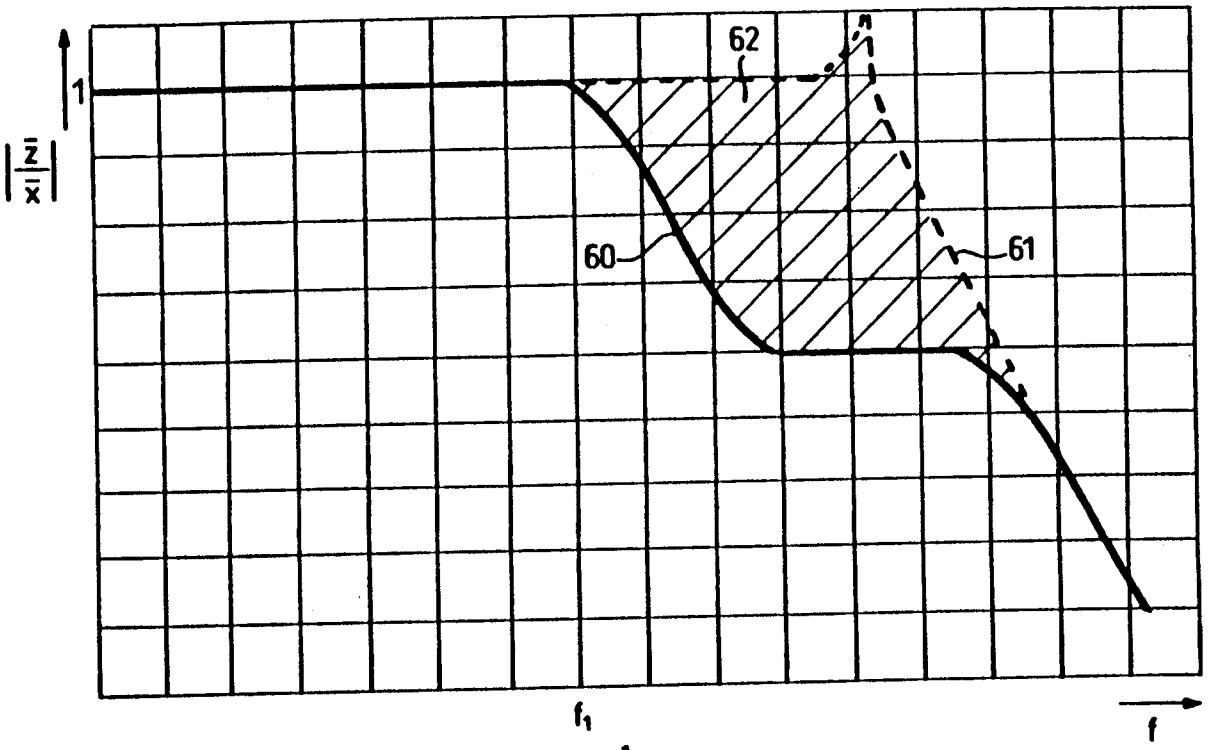

$$\frac{\bar{z}}{\bar{x}} = \frac{1 + \left(\frac{\partial 1}{\partial U}\right) \frac{\left(\frac{\partial Q}{\partial P}\right)_D m_1}{R_2^2 C_2^2}}{1 + \frac{(j\omega R_2 C_2)^2}{1 + j\omega R_2 C_2}} \cdot \frac{1}{1 + (j\omega \sqrt{\frac{m_1}{\left(\frac{\partial P}{\partial 1}\right)_D} + \frac{m_1}{\left(\frac{\partial P}{\partial 1}\right)_T}})^2} \cdot \frac{1}{1 + (j\omega \sqrt{\frac{m_1}{\left(\frac{\partial P}{\partial 1}\right)_D} + \frac{m_1}{\left(\frac{\partial P}{\partial 1}\right)_T}})^2} \cdot \bar{G}$$

Fig.4

METHOD AND APPARATUS FOR REDUCING ACOUSTIC EMISSION FROM SUBMERGED SUBMARINES

The invention concerns a method for reducing acoustic emission from submerged submarines wherein moving mechanical elements in the inner region transfer vibrations to an outer hull via a transport path and the vibrations are attenuated on the transport path.

The invention further concerns an apparatus for the reduction of acoustic emission of submerged submarines with which damping means are arranged between a moving mechanical element in the inner region of the submarine and an outer hull.

With the invention the submarines should, in particular, become camouflaged.

This application is related to the following co-pending U.S. Applications filed on Nov. 15, 1990:

(1) U.S Patent Application entitled "METHOD FOR INFLUENCING AN ACOUSTIC SOURCE, IN PARTICULAR OF A SUBMERGED SUBMARINE, AND SUBMARINE", Ser. No. 614,300, filed Nov. 15, 1990, corresponding to International Application PCT/DE 90/00197;

(2) U.S. Patent Application entitled "METHOD AND APPARATUS FOR LOCALIZING SUBMARINES", Ser. No. 615,432, filed Nov. 15, 1990, corresponding to International Application PCT/DE 90/00193;

(3) U.S. Patent Application entitled "UNDERWATER VEHICLE WITH A PASSIVE OPTICAL OBSERVATION SYSTEM", Ser. No. 602,314 filed Nov. 15, 1990, corresponding to International Application PCT/DE 90/00196;

(4) U.S. Patent Application entitled "METHOD FOR OPERATING SUBMERGED SUBMARINES AND SUBMARINES", Ser. No. 602,317, filed Nov. 15, 1990, corresponding to International Application PCT/DE 90/00194;

(5) U.S. Patent Application entitled "METHOD AND APPARATUS FOR REDUCING ACOUSTIC EMISSION FROM SUBMERGED SUBMARINES", Ser. No. 614,200, filed Nov. 15, 1990, corresponding to International Application PCT/DE 90/00195; and (6) German Patent Application P3908573.2 entitled "METHOD AND APPARATUS FOR OPERATING SUBMERGED SUBMARINES".

Each of the above-identified applications is assigned to the assignee of the present application, and the disclosures thereof are hereby incorporated by reference into this application.

Within the scope of submarine combat, one uses both active as well as passive systems to locate submarines.

With active systems (for example SONAR), a search signal, in general, an acoustic signal in the sonic or infrasonic region is radiated from on board a search vehicle, for example, from a frigate. These acoustic signals are reflected from the outer surface of the submarine and reach receivers on board the searching vehicle such that, from these received signals, by means of suitable analysis procedures, the position of the submarine can be determined.

It is known in the art that, in order to protect submarines from such active position-finding methods, the submarine is furnished with a coating on its outer hull which absorbs, as well as possible, the impinging acoustic signals.

An underwater vessel which is intended to be camouflaged from detection by low frequency active sonar, that is, a active acoustic locating system, is known in the art from DE-OS 33 32 754. Towards this end, wide band wedge-shaped absorbers are arranged, in particular, on the bow and on the bow side of the tower area which, for their part, are fitted to the respective ship contours and which, themselves, have no acoustic reflection properties. In this manner the detectability of the submarine, namely the so-called target size, should be reducible by approximately 10 to 15 dB.

The reduction of turbulent flow around submerged parts of submarines through the introduction of chemical additives has also been proposed (DE-OS 23 18 304).

Passive location methods, on the other hand, exploit physical phenomena caused by the submarine itself. In this manner, for example, it is known in the art that the perturbation on the earth's magnetic field by the submarine's metallic parts can be exploited in order to locate submarines. Accordingly, locating probes are known in the art which are based on the principle of nuclear magnetic resonance and which are towed by ships or airplanes on a long line over the region of the sea being searched in order to detect distortions in the earth's magnetic field.

A further passive locating method as is, for example, described in EP-PS 63 517, EP-OS 120 520 as well as in EP-PS 213 418 is based on the measurement of acoustic signals which are radiated from the submarine. Namely, a submarine radiates sound into the surrounding sea water to the extent that moving parts in the submarine transfer vibrations to the outer hull. Primarily, measurable acoustic signals are produced by moving propulsion elements of the submarine such as from the rotating parts of the drive-motor and from the shaft, whereby the rotating propeller and the cavitation caused by the propeller must also be considered as acoustic sources. Finally, acoustic signals are also produced by the operation of the elevators and depth rudders, through the release of air, and through the displacement of trimming loads, all of which can be detected with appropriately sensitive passive locating systems on board modern frigates.

Moreover, in this connection, submarines with a nuclear propulsion mechanism have the particular feature that nuclear reactors, as employed on board submarines, are usually equipped with periodically actuated control rods. The control rods are moved with a preset frequency in the reactor vessel, whereby the depth of immersion of the control rods is adjustable so that, in this manner, the power output of the nuclear reactor can be adjusted. However, as a result of the periodic motion of appreciably large masses, there arises a relatively intense acoustic signal which can be utilized for the location of these types of nuclear propelled submarines.

On the other hand, it is known in the art that, with modern passive acoustic locating systems of ever increasing sensitivity, it is also necessary to consider, to a greater extent, the sound which is present in the submarine's environment. This sound of natural origin is essentially produced by sea currents, waves, schools of fish and the like.

In operating passive acoustic locating systems this environmental sound is noticeable as noise which, depending on the environmental conditions, can assume a uniform or non-uniform frequency distribution.

Known in the art from DE-OS 34 06 343 is a method with which acoustic signals from submarines whose intensities lie only slightly above that of the environmental noise can be distinguished from the environmental noise.

Numerous measures are known in the art for preventing the detection of submarines using the passive acoustic locating systems described above.

The principal measures consist naturally of minimizing the entire acoustic output of the submarine. In order to achieve this, machine parts are utilized which are as silent as possible, for example bearings, particularly in the propulsion area of the submarine, so that the entire amount of acoustic energy produced is kept as small as possible.

Furthermore, it is also known in the art within the purview of the method and the apparatus of the above mentioned kind, to undertake acoustic attenuation measures on board submarines in order to at least keep unavoidable sound from reaching the outer hull. The attenuators used for this purpose are elastic and vibration absorbing parts known in the art which, together with the mechanical elements being attenuated, constitute a spring-weight system. These kinds of known methods are, within the context of the present invention, denoted as "passive attenuation". Making the outer hull double-walled and flooding the, by way of example, 30 cm thick region between the double walls with sea water in order to minimize the amount of acoustic waves which reach the outer hull of the submarine is, for example, known in the art.

Furthermore, in dangerous situations, the amount of radiated acoustic waves can also be reduced by reducing propulsion in a slow-motion advancing mode (referred to in German language as "Schleichfahrt"). However, this diminishes naturally the submarine's ability to escape detection by distancing itself from enemy ships.

Known in the art from DE-OS 36 00 258 is an electrical installation for submaraines which exhibits means of camoflage. In the arrangement which is known in the art, one takes into consideration the fact that a submarine alternating current network operates in the frequency range between 60 Hz and 400 Hz and that it is unavoidable that frequencies in this frequency range including harmonics are released via the hull into the surrounding water. Accordingly, in the electrical installation known in the art, the alternating current network of the submarine is provided with a frequency of, for example, 30 kHz which lies far above the receiver frequency range of hostile locating systems.

However, this electrical installation which is known in the art has the disadvantage that it can only effect a camouflage of the submerged submarine so long as enemy passive locating systems do not also operate in the frequency range region of, for example, 30 kHz. Therefore, in an installation known in the art, as soon as the precautions taken are known to the respective enemy, said enemy can, through appropriate reconfiguration of his passive locating system, locate the submerged submarine by examining the new frequency range.

Finally, it is also known in the art how to disrupt passive acoustic locating systems on board enemy ships by dropping objects which radiate with high acoustic power, thereby saturating the sensitive receivers of the passive acoustic locating system.

In this manner, for example, known in the art from DE-OS 33 00 067 is an apparatus to disrupt the location of submarines with which a body can be expelled from a submarine which is equipped to release sound. This body serves to confuse a sonar system, that is to say, an active acoustic locating system on board an enemy vessel.

Known in the art from EP-OS 237 891 is a device to disrupt and decoy water acoustic locating arrangements. In the device which is known in the art, a carrying body is equipped with pyrotechnic charges the burn-up of which leads to the pulsed release of gas bubbles which, for example, cause low frequency structure-born vibrations and high frequency vibrations of outer cavitating layers of a housing, from which they emerge to also form a bubble-curtain. The device known in the art is supposed to effect diversion from the object to be protected and, through the slowly drifting accumulation of bubbles, simulate a reflecting target.

However, the range of applicability of this kind of disruptive object is limited to the case where the presence of the submarine is already known on board the enemy ship and what should be prevented is only the ability to precisely locate fired torpedos with passive acoustic locating systems, which are also in motion and emitting sound. These types of disruptive objects are not suited for a situation in which a submarine wishes to remain completely undiscovered.

Accordingly, it is an object of the present invention, to further develop a method and a submarine of the above mentioned kind in such a way that the localization through passive acoustic localizing systems is made substantially more difficult if not, thereby, impossible in that the amplitude of the signals received by the passive acoustic locating systems enter into and are buried within the range of naturally occurring noise.

This object is achieved according to the above mentioned method in that the vibrations are actively damped by sensing the motion of mechanical elements relative to the outer hull and superimposing upon this motion a motion of opposite direction.

The object of the invention is achieved in accordance with the above mentioned apparatus in that the damping means exhibit a detector to ascertain as well as a translator to adjust the relative position of the element with respect to the outer hull and in that a regulator is wired between one output of the detector and one input of the translator such that, in case of a change in the relative position, the translator adjusts the relative position in an opposite direction.

In this manner, the object underlying the invention is completely achieved.

By compensating the relative movements of the elements with respect to the outer hull, said movements being in sympathy with the vibrations, through the superposition of an oppositely directed second motion, the submarine finds itself, in the ideal case, as seen from the outside, in a state of rest so that the vibrations emitted into the surrounding sea water are suppressed or at least substantially reduced in acoustic power. The acoustic signals radiated from the submarine are in this manner so strongly reduced that they are buried in the noise produced in an enemy vessel's passive locating system by naturally occurring environmental sound.

In a particularly preferred embodiment of the apparatus according to the invention, the detector and the translator are arranged in series in a transport path between the element and the outer hull.

This measure has the advantage that exact agreement is established in the spatial position of the disturbing variable, namely the motion in sympathy with the vibration, and the correcting variable, namely the opposing motion produced by the translator so that the disturbing variable can be exactly compensated for in amplitude, direction, and phase.

In a further preferred embodiment of the apparatus according to the invention, the detector is a sensor to ascertain the force exerted on the outer hull from the seismic mass of the element in consequence of the motion-causing acceleration.

This measure has the advantage that even the smallest excursions such as those which occur through the dispersion of sound in the structural components of a submarine, can be reliably ascertained, this only being possible with substantial effort using other position sensors.

In further embodiments of the apparatus according to the invention, both the detector and the translator exhibit piezo elements.

This measure has the advantage not only on the one hand that the forces corresponding to the disrupting vibrational motion are transformed into an electrical signal, but also on the other hand that from an electrical correction signal, an opposing motion can be produced in the translator. By utilizing similar piezo elements in the detector and in the translator one can, moreover, profit from a situation in which both piezo elements have the same environmental conditions, for example the same temperature, so that corresponding effects compensate each other.

Finally, in a particularly preferred embodiment of an apparatus in accordance with the invention, the outer hull is connected via at least three supports to an inner hull said inner hull receiving the moving elements, and the supports exhibit at least one detector and one translator each.

This measure has the advantage that all sources of vibration, namely the moving mechanical elements, are arranged in a closed inner region, said region being enclosed within the inner hull. Accordingly, all acoustic events which can spread to the outer hull, must take a path through the inner hull and can, essentially, only be transmitted to the outer hull via the supports. Since, however, the supports are equipped with the active damping measures explained above, an effective shielding of the outer hull from all kinds of acoustic events emanating from the moving mechanical elements is, in this manner, achieved.

Further advantages can be extracted from the description and the accompanying drawings.

Clearly, the features described above and the remaining features which are explained below are applicable not only in the given corresponding combination but also in other combinations or by themselves without departing from the scope of the present invention.

Figure 2:
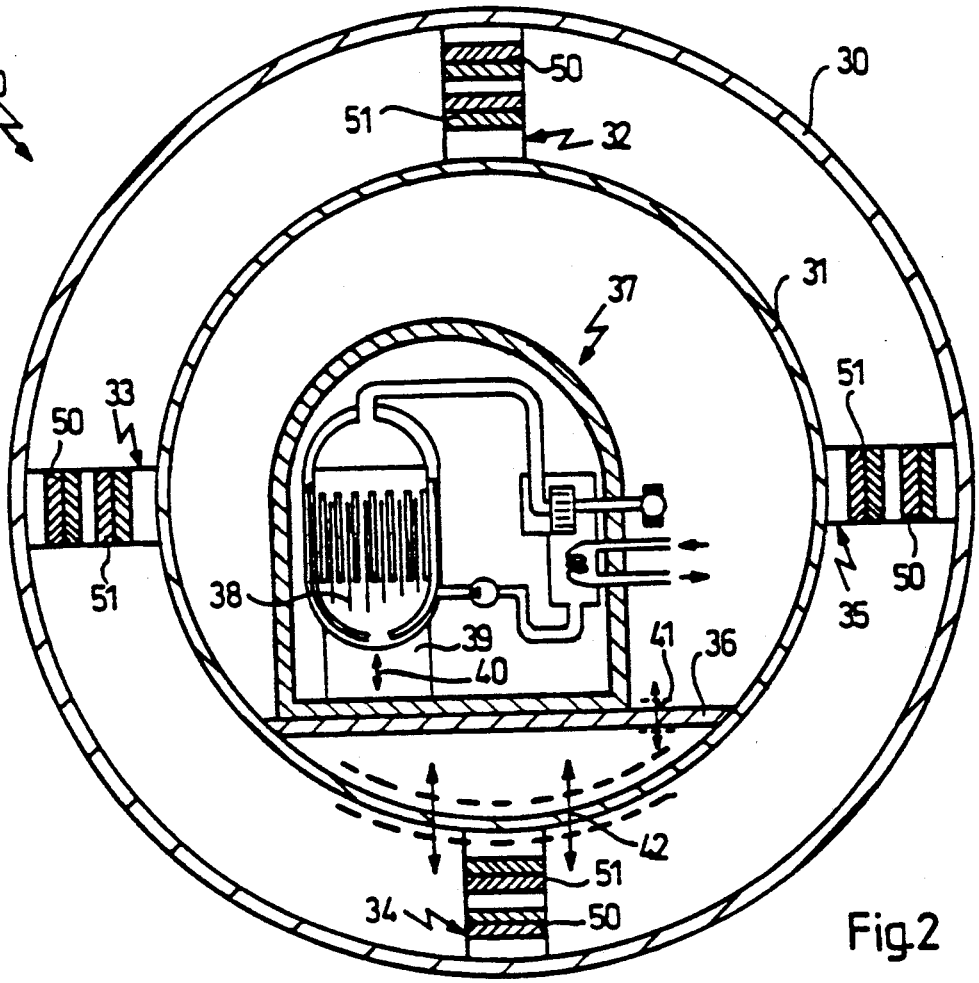
Figure 3:
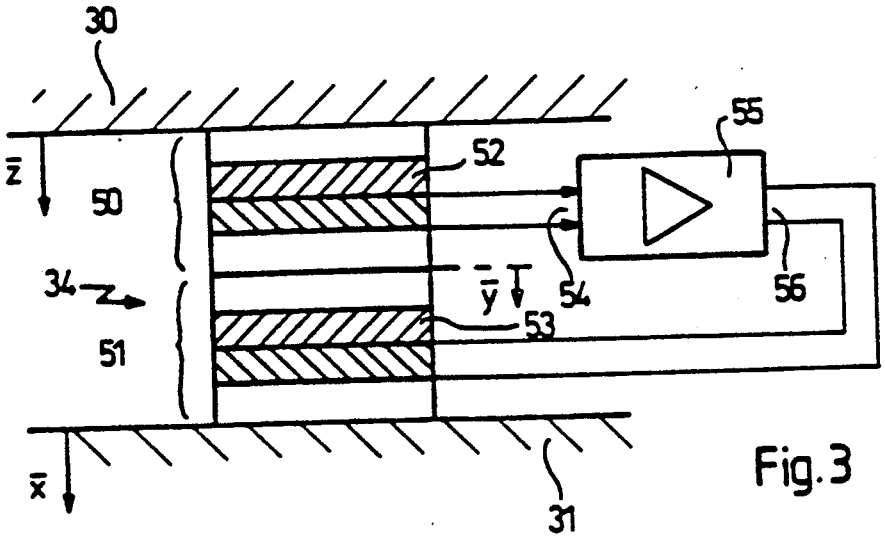
Figure 5:
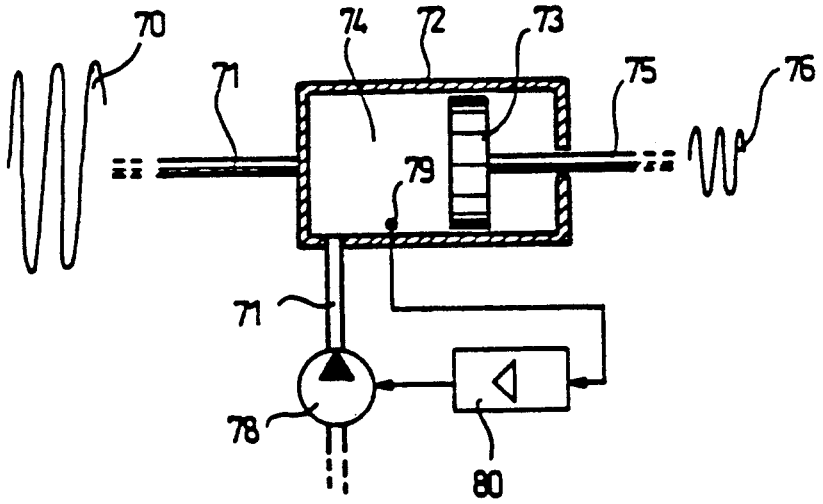

Embodiments of the invention are represented in the drawings and will be further explained in the following description. Shown are:

FIG. 1. a schematic view of a combat situation in which a frigate attempts by means of a passive acoustic locating system to locate a submerged submarine;

FIG. 2 an extremely schematic longitudinal section through a submarine at the position of a nuclear propulsion mechanism on board of same;

FIG. 3 a highly enlarged section from FIG. 2 for explanation of the use of an actively damped support according to the invention;

FIG. 4 a diagram of the frequency response of the active damping support according to the representation of FIG. 3;

FIG. 5 a further embodiment of an active damping support.

In the combat situation represented in FIG. 1, a frigate 11 in search of submarines is located upon a sea denoted by 10.

Beneath a water line 12 of the frigate 11, said frigate 11 is equipped with a passive acoustic locating system 13, which, for example, exhibits an opening cone 14. The frigate 11, for its part, produces acoustic waves 15, in particular through the propulsion of the frigate 11.

Under the surface of the sea 10, located at a depth which is not drawn to scale, is a submarine 20 with a nuclear propulsion mechanism 21. Labeled as 22 is an extremely schematic submarine 20 drive shaft which leads to a propeller 23. Acoustic waves which are radiated from the submarine 20 are labeled as 24, 25, and 26.

Hereby, 24 is supposed to symbolize the fraction of acoustic waves produced through the control rod movement mechanism of the nuclear propulsion mechanism 21 as will be further explained in connection with FIG. 2 below.

25 is supposed to symbolize the fraction of acoustic waves produced through the submarine drive elements, in particular through the rotating shaft, the rotating motor elements and the like.

Finally, 26 is supposed to symbolize the fraction of acoustic waves which are produced through the rotation of the propeller 23, in particular through the cavitation caused by the propeller.

The submarine is, for its part, likewise armed with a passive acoustic locating system 27 which subtends a cone 28.

In order to additionally reduce the amplitude of the acoustic radiation of the submarine 20, active damping measures are undertaken on board the submarine in accordance with the invention as will be explained below.

FIG. 2 shows a radial cut through the submarine 20 in accordance with FIG. 1, namely, at the position of the nuclear propulsion mechanism 21.

One notices that the submarine 20 is equipped with an outer hull 30 which completely encloses an inner hull 31. The inner hull 31 is supported inside the outer hull 30 by means of four active damping supports 32 through 35 distributed around the girth of the inner hull 31. Clearly, the supports 32 through 35 can be arranged to be discretely distributed along the length of the submarine 20.

The supports 32 through 35 can also be arranged to be at an angle relative to a radius rather than, as is shown in FIG. 2, in a radial direction, and it is likewise conceivable that, instead of four supports 32 through 34 displaced by 90 degrees with respect to each other around the girth of the inner hull, also three supports of this kind or more than four supports can be employed without going beyond the framework of the present invention.

Arranged on a floor 36 in the inner hull 31 is a nuclear reactor 37. The nuclear reactor 37 is of conventional construction and exhibits control rods 38 which can be driven by means of a control rod drive mechanism 39 in the direction of arrow 40 into or out of a reactor vessel.

In nuclear reactors 37 of the type which is of interest here, as they are used on board submarines 20, one usually proceeds in such a manner that the control rods 38, moving periodically, penetrate into the reactor vessel whereby the power output of the nuclear reactor 37 is adjusted through amplitude modulation, that is to say, through variation of the penetration depth of the control rods 38.

This means that, due to the periodic motion of the control rods 38, indicated by the arrow 40, a vibration is produced which is transferred from the nuclear reactor 37 to the floor 36. This is indicated in FIG. 2 with an additional arrow 41. Since the floor 36, for its part, is firmly anchored in the inner hull 31, said inner hull 31 also begins to oscillate, which is indicated in FIG. 2 with an additional arrow 42.

In the manner described above, a transport path is thereby established between the periodically moving control rods 38 through to the inner hull 31, whereby, in consequence of excited self resonances of submarine 20 construction parts which are in the transport path, resonant amplification can also take place.

In order to cut-off or to at least substantially damp further transfer of these vibrations onto the outer hull 30, the supports 32 through 35 are equipped as active damping elements. Towards this end, arranged in each of the supports 32 through 35 are a detector 50 and a translator 51 connected in series, whereby each respective detector 50 is situated at the outer hull 30.

A "detector" should be understood to be every element which is capable of identifying relative motion of a moving mechanical element, in the present case, that of the inner hull 31 relative to the outer hull 30. Towards this end, pressure sensors as well as distance sensors such as, for example, an interferometer or the like can be utilized.

On the other hand, a "translator" should be understood to be every device which is capable of producing a particular displacement in functional response to a control signal.

In the enlarged representation of FIG. 3, the detector 50 and the translator 51 can again be seen, and one clearly notices that both the detector 50 as well as the translator 51 each exhibit a piezo element 52 or 53. The piezo detector element 52 is connected to an input 54 of a servo amplifier 55 the output of which 56 is connected to the piezo translator element 53.

If then the inner hull is displaced as a consequence of some kind of mechanical motion from its interior, as had been further explained above by means of arrows 40 through 42, the inner hull 31 then experiences a displacement in the axial direction of the supports 34 which is characterized in FIG. 3 with the complex quantity $\bar{x}$.

With an outer hull mass of $m_1$, as a consequence of the acceleration caused by the the motion $\bar{z}$ of the outer hull 30, a force is thereby exerted on the detector 50 such that a complex electrical signal from the piezo detector element is passed on to the input 54 of the servo amplifier 55. Depending on the amplification, the frequency response, and the regulation characteristics of the servo amplifier 55, said servo amplifier 55 produces an electrical signal at its output 56 which is fed to the piezo translator element 53. The translator 51 is thereby driven to move in a direction opposite to that of the motion $\bar{y}$ so that the motion of the outer hull 30 characterized in FIG. 3 with the complex quantity $\bar{z}$ can be zeroed or at least be substantially minimized.

FIG. 4 shows the frequency response for transmission, that is to say, the ratio of the quantities $\bar{z}$ and $\bar{x}$ as a function of frequency f for a particular configuration of the elements which are involved. Also given in FIG. 4 is the formula for the transmission whereby $m_1$ has already been defined as the mass of the inner hull 31 including the construction elements of the submarine which are arranged thereon. The quotient $(\delta P/\delta l)_D$ characterizes the stiffness of the detector 50, the quotient $(\delta P/\delta l)_T$ characterizes the stiffness of the translator 57, the quotient $(\delta l/\delta U)$ characterizes the sensitivity of the translator 51, the quotient $(\delta Q/\delta P)$ characterizes the sensitivity of the detector 50, R2 is the internal resistance of the detector, C2 is the capacitance of the detector and, finally, the complex quantity $\bar{G}$ represents the complex amplification of the servo amplifier 55.

The solidly drawn line 60 in FIG. 4 corresponds to the case of a practical application which, for very low frequencies exhibits a transmission of magnitude 1, then, however decreases sharply in an intermediate step so that, above a limiting frequency $f_1$, a continuously increasing damping of $\bar{x}$ with respect to $\bar{z}$ occurs.

By way of comparison, a dashed line 61 is drawn in FIG. 4 in which the same configuration with passive damping has been calculated. Passive damping is to be understood to mean springs and the like. One clearly notices that, in the case of curve 61, the magnitude of the transmission continues to assume the value 1 over several orders of magnitude of the logarithmically plotted frequency f, then initially goes over into the self resonance characteristic of passively damped systems before decreasing to values smaller that 1, and does not assume the same damping behavior as the active damping system until reaching very high frequencies of more than 6 orders of magnitude above the limiting frequency $f_1$.

The gain achieved by applying active damping (curve 60) according to the invention in comparison to conventional passive damping (curve 61) is clearly illustrated by the intermediate region 62, which is cross-hatched in FIG. 4.

Through appropriate dimensioning of the elements involved, in particular in the region of the supports 32 through 35 as well as the servo amplifier 55, the region 62 can be made to correspond to the frequency region of usual aggregates of moving parts on board a submarine, most importantly to the revolutions per minute of the submarine drive elements as well as the aggregate of heavy accessory parts.

FIG. 5 shows, finally, another variation using a fluid active damping element.

Labeled with 70 in FIG. 5 is a first vibration of larger amplitude, which is, for example, the vibration of the inner hull 31. This vibration is transmitted via a first rod symbolized by 71 onto a cylinder 72 within which runs a piston 73. A pressure region 74 is then located between piston 73 and cylinder 72. The piston 73 is, in turn, connected to a second rod 75 which transfers a second vibration 76 of significantly reduced amplitude or even of an amplitude which is compensated to zero to, for example, the outer hull 30.

Connected to the pressure region 74 is a pressure conduit 77 which leads to an adjustable pressure source 78. In addition, a pressure sensor 79 is arranged in pressure region 74 which relays a signal to a regulator 80, said signal corresponding to the pressure present in pressure region 74. The regulator 80, in turn, controls the pressure source 78, for example, a pump.

Also in this case of fluid, for example, pneumatic or hydraulic damping elements, in the event of displacement of the first rod 71 in one direction, an oppositely directed motion of the second rod 75 through appropriate measurement of the pressure in pressure region 74 and through adjustment of said pressure by means of the adjustable pressure source 78 is achieved in a manner which does not require further explanation.

Also for the arrangement in accordance with FIG. 5, it is possible with the aid of equivalent circuits to derive a formula for the transmission which corresponds to the formula represented in FIG. 4 in conjunction with the case of active damping using piezo elements with the frequency response of the configuration according to FIG. 5 also corresponding to that of FIG. 4.

We claim:

1. A submarine comprising:

an outer hull being in contact with surrounding sea water;

an inner hull being enclosed by said outer hull;

a source of acoustic emission generated by a moving mechanical element of said source, said source being contained within said inner hull; and supports arranged between said inner hull and said outer hull for mechanically supporting said inner hull with respect to said outer hull, said supports comprising active damping means for reducing acoustic vibrations being transmitted along a vibration transmission path from said source via said inner hull via said supports to said outer hull, said active damping means having arranged within said transmission path:

a detector comprising a piezo element and being positioned adjacent said outer hull for converting a relative motion of said outer hull caused by said acoustic vibrations into a first electrical signal;

a translator arranged in series with said detector and being positioned adjacent said inner hull, said series arrangement of said detector and said translator forming a section of said transmission path, said translator being designed for converting a second electrical signal into a relative motion of said inner hull; and an amplifier having an input connected to said detector for receiving said first signal and having an output connected to said translator for providing said second signal, said amplifier being designed to convert said first signal into said second signal such that said translator motion and said outer hull motion are essentially compensated against each other.

* * * * *